US010256560B2

(12) United States Patent
Fertig et al.

(10) Patent No.: US 10,256,560 B2
(45) Date of Patent: Apr. 9, 2019

(54) FLAT CONTACT SOCKET WITH A CANTILEVER

(71) Applicant: TE Connectivity Germany GmbH, Bensheim (DE)

(72) Inventors: Jochen Fertig, Bensheim (DE); Holger Stange, Frankenthal (DE); Niranjan Thirunavukkarasu, Neu-Isenburg (DE); Joachim Toboldt, Furth (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 15/795,461

(22) Filed: Oct. 27, 2017

(65) Prior Publication Data

US 2018/0123276 A1 May 3, 2018

(30) Foreign Application Priority Data

Oct. 28, 2016 (DE) ..... 10 2016 221 351

(51) Int. Cl.
*H01R 13/11* (2006.01)
*H01R 13/18* (2006.01)
(Continued)

(52) U.S. Cl.
CPC ..... *H01R 13/113* (2013.01); *H01R 11/11* (2013.01); *H01R 12/7088* (2013.01); *H01R 13/18* (2013.01); *H01R 13/187* (2013.01); *H01R 13/22* (2013.01); *H01R 13/35* (2013.01); *H01R 13/6275* (2013.01); *H01R 4/023* (2013.01);
(Continued)

(58) Field of Classification Search
CPC ..... H01R 13/187; H01R 13/113
See application file for complete search history.

(56) References Cited

U.S. PATENT DOCUMENTS 3,097,906 A * 7/1963 Shannon ..... H01R 11/22 439/224
3,976,348 A * 8/1976 Simmons ..... H01R 11/00 439/268
(Continued)

FOREIGN PATENT DOCUMENTS

DE 102005017988 B3 11/2006
DE 102014005536 A1 10/2015
(Continued)

OTHER PUBLICATIONS

German Office Action, dated Aug. 22, 2017, 5 pages.
(Continued)

*Primary Examiner* — Ross N Gushi
(74) *Attorney, Agent, or Firm* — Barley Snyder

(57) ABSTRACT

A flat contact socket comprises a connection section and a socket body connected to the connection section. The socket body has a flat contact receptacle and a blocking element. The flat contact receptacle extends along a flat contact plane and receives a flat contact in an insertion direction at an insertion opening of the flat contact receptacle. The blocking element is positioned opposite the insertion opening in the insertion direction and delimits the flat contact receptacle in the insertion direction. The blocking element extends transverse to the insertion direction from a cantilever extending in the insertion direction.

16 Claims, 4 Drawing Sheets

(51) Int. Cl.

| | |
|---|---|
| ***H01R 13/187*** | (2006.01) |
| ***H01R 13/22*** | (2006.01) |
| ***H01R 13/35*** | (2006.01) |
| ***H01R 13/627*** | (2006.01) |
| ***H01R 11/11*** | (2006.01) |
| ***H01R 12/70*** | (2011.01) |
| *H01R 13/24* | (2006.01) |
| *H01R 43/16* | (2006.01) |
| *H01R 4/02* | (2006.01) |
| *H01R 4/48* | (2006.01) |

(52) U.S. Cl.
CPC ..... *H01R 4/48* (2013.01); *H01R 13/2442* (2013.01); *H01R 43/16* (2013.01)

(56) References Cited

U.S. PATENT DOCUMENTS 4,421,375 A * 12/1983 Coldren ..... H01R 4/2462 439/423
4,478,470 A * 10/1984 Fruchard ..... H01R 13/20 439/268
4,534,613 A * 8/1985 Esser ..... H01R 13/20 439/834
4,550,963 A * 11/1985 Moors ..... H01R 13/115 439/170
4,564,259 A * 1/1986 Vandame ..... H01R 13/113 439/290
4,679,887 A * 7/1987 Jackson ..... H01R 13/20 439/849
4,685,754 A * 8/1987 Coldren ..... H01R 13/20 439/270
4,696,530 A * 9/1987 Vandame ..... H01R 13/113 439/266
4,934,966 A * 6/1990 D'Urso ..... H01R 13/20 439/849
5,525,070 A * 6/1996 Axelsson ..... H01R 13/20 439/268
5,588,884 A * 12/1996 Rudoy ..... H01R 13/187 439/787
5,667,414 A * 9/1997 Karacora ..... H01R 4/2454 439/397
5,800,220 A * 9/1998 Feeny ..... H01R 13/113 439/849
5,911,605 A * 6/1999 Wooldridge ..... H01R 13/28 439/790
6,039,615 A * 3/2000 Suzuki ..... H01R 13/113 439/849
6,276,960 B1 * 8/2001 Schaefer ..... H01R 11/287 439/466
6,287,156 B1 * 9/2001 Swan ..... H01R 13/187 439/790
6,416,340 B2 * 7/2002 Schaefer ..... H01R 13/187 439/224
6,485,337 B2 * 11/2002 Hsieh ..... H01R 13/187 439/790
6,527,600 B2 * 3/2003 Alonso Merino ... H01R 13/113 439/842
6,579,132 B2 * 6/2003 Sato ..... H01R 13/113 439/852
6,672,911 B2 * 1/2004 Zhao ..... H01R 11/22 439/271
6,692,316 B2 * 2/2004 Hsieh ..... H01R 13/187 439/224
7,150,660 B2 * 12/2006 Allgood ..... H01R 11/289 439/845
7,241,189 B2 * 7/2007 Mohs ..... H01R 13/113 439/845
7,465,199 B2 * 12/2008 Osada ..... H01R 4/185 439/845
7,789,720 B2 * 9/2010 Zinn ..... H01R 13/113 439/370
7,845,993 B2 * 12/2010 Falchetti ..... H01R 13/18 439/843
8,038,488 B2 * 10/2011 Mukuno ..... H01R 13/187 439/845
8,057,261 B1 * 11/2011 DeSio ..... H01R 13/506 439/625
8,128,441 B2 * 3/2012 Mukuno ..... H01R 13/187 439/845
8,419,486 B2 * 4/2013 Tyler ..... H01R 13/113 439/842
8,647,160 B2 * 2/2014 Umemoto ..... H01R 13/113 439/845
8,668,531 B2 * 3/2014 Yamaguchi ..... H01R 13/187 439/843
8,795,005 B2 * 8/2014 Blakborn ..... H01R 13/113 439/788
8,827,754 B2 * 9/2014 Lee ..... H01R 13/113 439/843
8,927,132 B2 * 1/2015 Kang ..... H01R 13/741 429/123
9,065,192 B2 * 6/2015 Zhao ..... H01R 13/113
9,142,901 B2 * 9/2015 Ando ..... H01R 13/113
9,257,769 B2 * 2/2016 Ito ..... H01R 13/02
9,397,419 B2 * 7/2016 Kang ..... H01R 12/53
9,490,596 B1 * 11/2016 Yu ..... H01R 24/60
9,509,066 B2 * 11/2016 Sasano ..... H01R 4/48
9,537,245 B1 * 1/2017 Cable ..... H01R 43/20
9,692,163 B1 * 6/2017 Didonato ..... H01R 4/70
9,705,229 B2 * 7/2017 Itou ..... H01R 4/184
9,716,331 B2 * 7/2017 Sasaki ..... H01R 13/113
9,716,332 B1 * 7/2017 Wimmer ..... H01R 13/03
9,722,328 B2 * 8/2017 Wimmer ..... H01R 4/489
9,905,950 B2 * 2/2018 Marsh ..... H01R 13/113
2002/0022412 A1 * 2/2002 Alonson Merino . H01R 13/113 439/849
2002/0025732 A1 * 2/2002 Hsieh ..... H01R 13/187 439/845
2003/0060090 A1 * 3/2003 Allgood ..... H01R 11/289 439/845
2003/0194919 A1 * 10/2003 Hsieh ..... H01R 13/187 439/845
2007/0066152 A1 * 3/2007 Mohs ..... H01R 13/113 439/843
2007/0202744 A1 * 8/2007 Dummel ..... H01R 13/113 439/607.01
2007/0218763 A1 * 9/2007 Rehbein ..... H01R 13/113 439/607.01
2009/0029605 A1 * 1/2009 Matsumoto ..... H01R 13/113 439/843
2009/0253315 A1 * 10/2009 Busies ..... H01R 13/113 439/884
2010/0029146 A1 * 2/2010 Myer ..... H01R 13/113 439/852
2010/0221930 A1 * 9/2010 Hying ..... H01R 13/115 439/77
2011/0039130 A1 * 2/2011 Baek ..... H01M 10/42 429/7
2011/0045712 A1 * 2/2011 Mukuno ..... H01R 4/4881 439/845
2011/0250798 A1 * 10/2011 Mukuno ..... H01R 13/055 439/660
2012/0100731 A1 * 4/2012 Umemoto ..... H01R 13/113 439/86
2012/0108113 A1 * 5/2012 Yamaguchi ..... H01R 13/187 439/842
2012/0129407 A1 * 5/2012 Glick ..... H01R 13/113 439/817
2012/0156947 A1 * 6/2012 Tyler ..... H01R 13/113 439/842
2012/0164893 A1 * 6/2012 Mitsuzuka ..... H01R 13/05 439/692
2012/0289101 A1 * 11/2012 Lee ..... H01R 13/187 439/878
2012/0315790 A1 * 12/2012 Hein ..... H01R 13/5812 439/574

(56) References Cited

U.S. PATENT DOCUMENTS

2013/0059484 A1* 3/2013 Kang ..... H01R 13/113 439/754
2014/0127954 A1* 5/2014 Ando ..... H01R 13/113 439/884
2014/0194016 A1* 7/2014 Kato ..... H01R 13/113 439/884
2014/0227915 A1* 8/2014 Glick ..... H01R 13/113 439/856
2014/0273659 A1* 9/2014 Glick ..... H01R 13/113 439/676
2014/0302702 A1* 10/2014 Germ ..... H01R 13/02 439/370
2014/0308857 A1* 10/2014 Goesmann ..... H01R 13/187 439/842
2014/0322976 A1* 10/2014 Raschilla ..... H01R 13/648 439/607.55
2015/0038000 A1* 2/2015 Glick ..... H01R 13/113 439/370
2015/0079856 A1* 3/2015 Zhao ..... H01R 13/113 439/816
2015/0093929 A1* 4/2015 Zhang ..... H01R 13/627 439/355
2015/0093944 A1* 4/2015 Omae ..... H01R 13/113 439/861
2015/0303593 A1* 10/2015 Ono ..... H01R 12/728 439/850
2016/0013586 A1* 1/2016 Kamei ..... H01R 13/502 439/246
2016/0134044 A1* 5/2016 Hirakawa ..... H01R 4/184 439/816
2016/0226170 A1* 8/2016 Marsh ..... H01R 13/113
2016/0254610 A1* 9/2016 Hirakawa ..... H01R 13/187 439/816
2016/0285178 A1* 9/2016 Wimmer ..... H01R 4/489
2016/0352034 A1* 12/2016 Sasaki ..... H01R 13/113
2016/0372855 A1* 12/2016 Itou ..... H01R 4/184
2017/0062955 A1 3/2017 Marsh et al.
2017/0062966 A1* 3/2017 Stange ..... H01R 13/113
2017/0141503 A1* 5/2017 Eckel ..... H01R 13/18
2017/0250488 A1* 8/2017 Zhang ..... H01R 13/426
2017/0302018 A1* 10/2017 Sasaki ..... H01R 13/113
2017/0310032 A1* 10/2017 Sasaki ..... H01R 13/113
2017/0324183 A1* 11/2017 Marsh ..... H01R 13/426
2017/0346248 A1* 11/2017 Eckel ..... H01R 13/22
2018/0034171 A1* 2/2018 Tyler ..... H01R 4/023

FOREIGN PATENT DOCUMENTS

EP 1211756 A1 6/2002
FR 2693041 A1 12/1993

OTHER PUBLICATIONS

Abstract of FR2693041, dated Dec. 31, 1993, 1 page.
Abstract of EP1211756, dated Jun. 5, 2002, 1 page.
Abstract of DE102005017988, dated Nov. 16, 2006, 1 page.
Abstract of DE102014005536, dated Oct. 22, 2015, 1 page.

* cited by examiner

FLAT CONTACT SOCKET WITH A CANTILEVER

CROSS-REFERENCE TO RELATED APPLICATION

This application claims the benefit of the filing date under 35 U.S.C. § 119(a)-(d) of German Patent Application No. 102016221351.2, filed on Oct. 28, 2016.

FIELD OF THE INVENTION

The present invention relates to a contact socket and, more particularly, to a flat contact socket receiving a flat contact.

BACKGROUND

Flat contact sockets which form an electrical connection between an electrical conductor and a flat contact are known in the art. The flat contact socket is typically cage-shaped or box-shaped to receive a flat contact in a flat contact receptacle of the flat contact socket. In some flat contact sockets, commonly referred to as connection brackets, two flat contacts can be inserted into the flat contact receptacle to establish an electrical connection between the two flat contacts.

Known flat contact sockets, however, are complex to produce, complicated to handle, or can only establish an insufficient mechanical and/or electrical connection between the electrical conductor and the flat contact. Further, known flat contact sockets frequently only have an insufficiently dimensioned flat contact receptacle, which makes it more difficult or impossible to receive flat contacts which have additional elements, for example, a touch protector.

SUMMARY

A flat contact socket according to the invention comprises a connection section and a socket body connected to the connection section. The socket body has a flat contact receptacle and a blocking element. The flat contact receptacle extends along a flat contact plane and receives a flat contact in an insertion direction at an insertion opening of the flat contact receptacle. The blocking element is positioned opposite the insertion opening in the insertion direction and delimits the flat contact receptacle in the insertion direction. The blocking element extends transverse to the insertion direction from a cantilever extending in the insertion direction.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
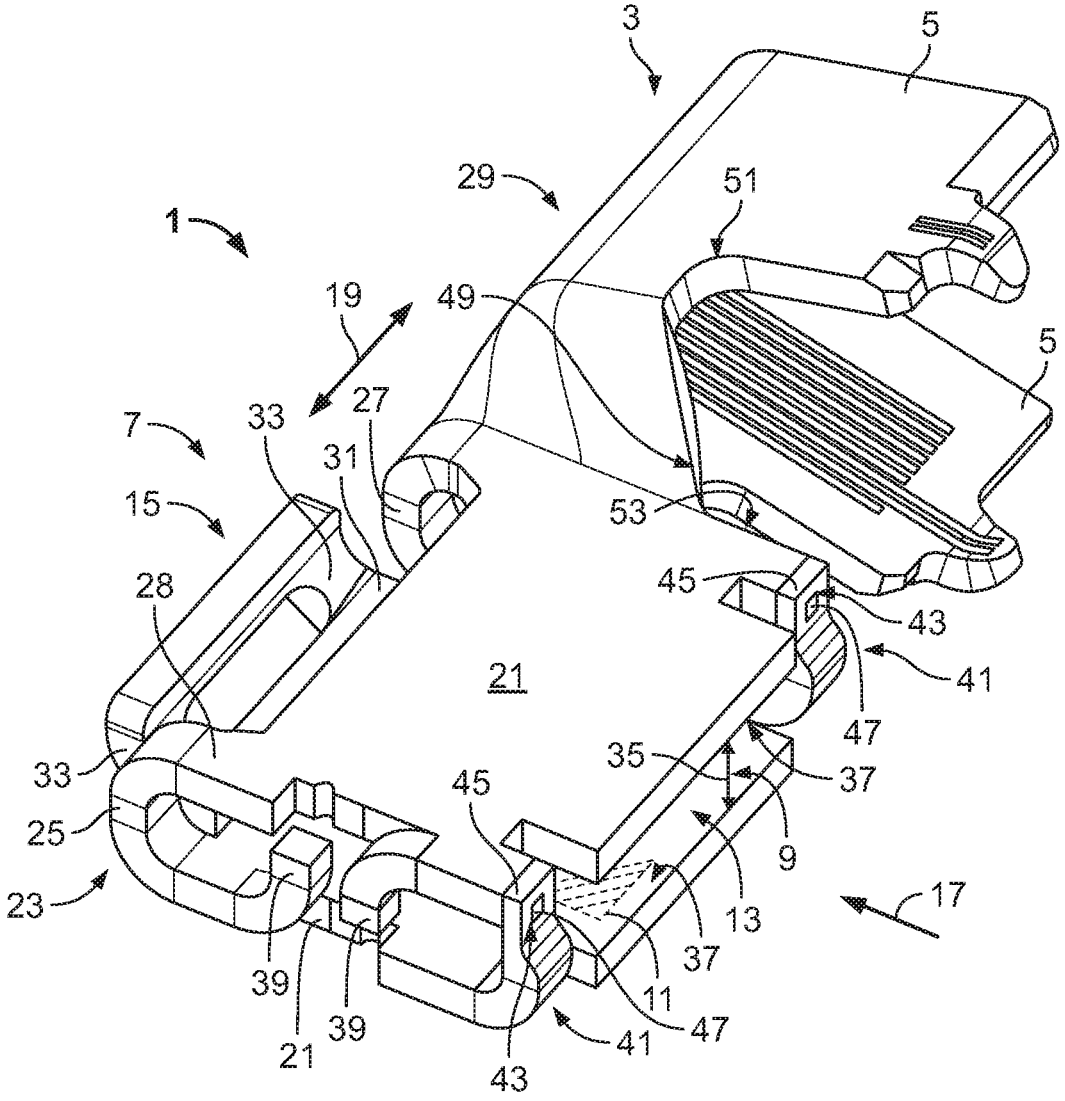
FIG. 1 is a perspective view of a flat contact socket according to an embodiment of the invention.

Embodiments of the present invention will be described hereinafter in detail with reference to the attached drawings, wherein like reference numerals refer to the like elements. The present invention may, however, be embodied in many different forms and should not be construed as being limited to the embodiments set forth herein; rather, these embodiments are provided so that the disclosure will be thorough and complete and will fully convey the concept of the invention to those skilled in the art.

A flat contact socket 1 according to an embodiment of the invention is shown in FIGS. 1-4. The flat contact socket 1 has a connection section 3 and a socket body 7 connected to the connection section 3. The connection section 3 electrically connects to an electrical conductor (not shown) and the socket body 7 electrically connects to a flat contact 63. In an embodiment, the flat contact socket 1 is monolithically formed from an electrically conductive material 28 by stamping and bending.

Figure 2:
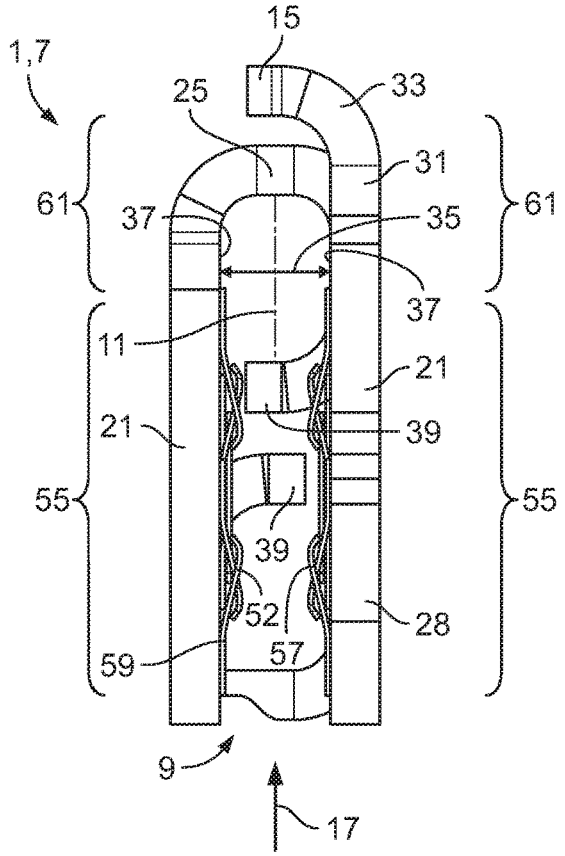
FIG. 2 is a sectional side view of a flat contact receptacle of the flat contact socket of FIG. 1.
Figure 3:
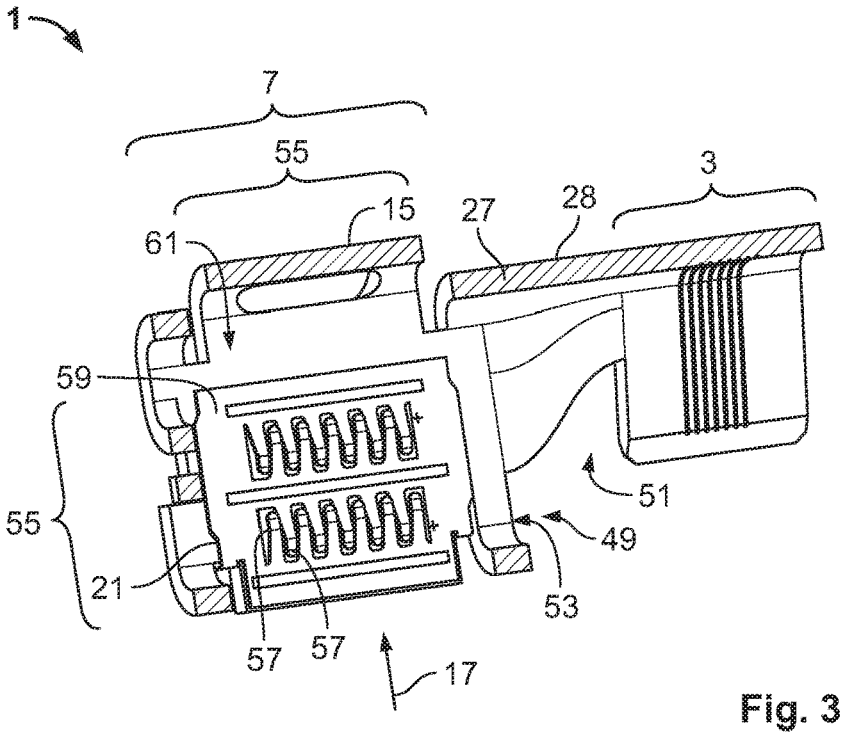
FIG. 3 is a sectional side view of a socket body of the flat contact socket of FIG. 1.

The connection section 3, as shown in the embodiment of FIGS. 1-3, is a crimping section and has at least two crimping wings 5. In other embodiments, the connection section 3 may be any type of section known to those with ordinary skill in the art capable of connecting to an electrical conductor such as a cable.

The socket body 7, as shown in FIGS. 1 and 2, has a flat contact receptacle 9 extending along a flat contact plane 11. The flat contact receptacle 9 has an insertion opening 13 receiving the flat contact 63. A blocking element 15 is arranged at an end of the socket body 7 opposite the insertion opening 13 and delimits the penetration depth for the flat contact 63 into the flat contact receptacle 9; an insertion direction 17 for the flat contact 63 extends from the insertion opening 13 towards the blocking element 15. The insertion direction 17 extends parallel to the flat contact plane 11. The insertion opening 13 and the blocking element 15 are thus located opposite one another in the insertion direction 17.

The flat contact socket 1 extends along a longitudinal direction 19 running transverse to the insertion direction 17, as shown in FIGS. 1 and 2. The connection section 3 and the socket body 7 are adjacent in the longitudinal direction 19. In the shown embodiment, the connection section 3 is configured such that the electrical conductor, in particular a cable, extends substantially parallel to the longitudinal direction 19 after connection to the connection section 3. In other embodiments, the flat contact socket 1 according to the invention may be shaped differently; for example, the connection section 3 may be connected to the socket body 7 in such a way that the connection section 3 extends away from it parallel to the insertion direction 17. In a further alternative, the connection section 3 may extend transverse to the insertion direction 17 and transverse to the longitudinal direction 19.

The socket body 7 has two flat legs 21 located opposite one another across the flat contact plane 11, as shown in FIGS. 1 and 2. The legs 21 delimit the flat contact receptacle 9 transverse to the flat contact plane 11. In an embodiment, the legs 21 are formed substantially continuous. Alternatively, the legs 21 may have openings. At a first end of the socket body 7, the two legs 21 are interconnected by two webs 25. At a second end of the socket body 7 opposite the webs 25 in the longitudinal direction 19, the legs 21 are connected by a base 27.

The base 27, as shown in FIGS. 1 and 3, extends transverse to the insertion direction 17 or parallel to the longitudinal direction 19 and forms a kind of backbone for the flat contact socket 1. The base 27 is opposite the insertion opening 13 in the insertion direction 17 and connects the socket body 7 to the connection section 3. In an embodiment, the base 27 is continuously formed at least between the socket body 7 and the connection section 3 for good electrical conductivity. The base 27 can be formed by a main bending edge 29 which extends transverse to the insertion direction 17. The two legs 21 are correspondingly formed by two flat regions bending towards each other around the main bending edge 29.

The blocking element 15, as shown in FIGS. 1 and 3, is connected to a cantilever 31 which extends away from the rest of the socket body 7 in the insertion direction 17. The blocking element 15 protrudes from the cantilever 31 transverse to the insertion direction 17 and transverse to the longitudinal direction 19; transverse to the flat contact plane 11. As a result, it is possible to receive the flat contact 63 in the flat contact receptacle 9, which projects beyond the rest of the socket body 7 at least in part in the insertion direction 17. The blocking element 15 is spaced apart from the rest of the flat contact receptacle 9 by the above-described arrangement.

In an embodiment, the blocking element 15 is produced in a single piece with the socket body 7 and the rest of the flat contact socket 1; the blocking element 15 and the cantilever 31 may be stamped from the material 28 of the flat contact socket 1. The blocking element 15 can thus transition continuously into one of the two legs 21, and the free end formed by the blocking element 15 can be bent up-wards transverse to the insertion direction 17 and transverse to the longitudinal direction 19.

The blocking element 15 has two braces 33 connecting the blocking element 15 to the cantilever 31 as shown in FIGS. 1 and 2. The blocking element 15 is beam-like in form, and the two braces 33 connecting the blocking element 15 to the cantilever 31 are spaced apart. Material 28 is stamped out or removed between the braces 33 to reduce the required bending forces for producing the shape of the blocking element 15 and for bending the material 28 upwards. In an alternative embodiment, the area between the braces 33 may also be closed. To delimit the flat contact receptacle 9 effectively in the insertion direction 17 using the blocking element 15, the blocking element 15 extends over half of a height 35 of the flat contact receptacle 9. The height 35 of the flat contact receptacle 9 is measured as a distance between inner faces 37 of the two legs 21 transverse to the flat contact plane 11.

In order to prevent the flat contact 63 from slipping out of the flat contact receptacle 9, the flat contact socket 1 can also feature further blocking or guide elements. In the embodiment shown in FIGS. 1-4, the end 23 of the flat contact socket 1 has two lateral blocking elements 39. The lateral blocking elements 39 close the flat contact receptacle 9 in the direction of the end 23, transverse to the insertion direction 17, and may be formed by stamping and bending from material 28 of the legs 21, wherein an approximately quadrantal lateral blocking element 39 extends from each leg 21 in the direction of the opposite leg 21; orientation of the two lateral blocking elements 39 is thus opposing.

For laterally guiding the flat contact 63 during insertion into the flat contact receptacle 9 and for fixing the position of the legs 21 relative to one another, the flat contact socket 1 has two latching elements 41 shown in FIG. 1. The latching elements 41 are arranged to the side of the flat contact receptacle 9 and are located opposite one another in the longitudinal direction 19, the flat contact receptacle 9 being arranged between them as viewed in the longitudinal direction 19. The latching elements 41 delimit the insertion opening 13 laterally in the longitudinal direction 19.

Each of the latching elements 41 extends from one leg 21 to the opposite leg 21 and has a positive engagement opening 43 arranged on the free end 45 of the latching element 41. Each latching element 41 is substantially strip-shaped, and may be stamped from material 28 of one of the two legs 21. The latching element 41 is bent towards the opposite leg 21 in such a way that the positive engagement opening 43 is arranged at the height of the opposite leg 21. Each leg 21 has a positive engagement protrusion 47, shown in FIG. 1, which in the connected state is disposed in the positive engagement opening 43, forming a positive engagement transverse to the insertion direction 17. This prevents undesired opening apart and pressing together of the two legs 21 as well as displacement of the two legs 21 in the longitudinal direction 19.

The flat contact socket 1, as shown in FIGS. 1 and 3, has a positive engagement recess 49 which extends substantially parallel to the insertion direction 17 into the flat contact socket 1. The positive engagement recess 49 extends in the direction of the base 27 from that side of the flat contact socket 1 which is opposite the base 27 counter to the insertion direction 17. The positive engagement recess 49 extends substantially between the socket body 7 and the connection section 3. The positive engagement recess 49 extends so far in the direction of the base 27 into the material of the flat contact socket 1 that the crimping wings 5 of the connection section 3 are shaped by the positive engagement recess 49 or by an elongation 51 of the positive engagement recess 49. A stop surface 53 is formed on the socket body 7 by the positive engagement recess 49 and extends parallel to the insertion direction 17.

The legs 21 have contacting sections 55, shown in FIGS. 2 and 3, which electrically contact the flat contact 63 disposed in the flat contact receptacle 9. The contacting sections 55 are arranged on the inner faces 37 of the legs 21. In various embodiments, it is possible for only one of the two legs 21 to have a contacting section 55. Alternatively, one of the legs 21 may also be provided with a pressing device which is formed for mechanically fixing the flat contact 63 in the flat contact receptacle 9.

Each contacting section 55, as shown in FIGS. 2 and 3, has multiple contact springs 57 which project into the flat contact receptacle 9 and are resiliently deflectable towards the associated leg 21. Each of the inner faces 37 has, in the contacting section 55, a contacting plate 59 which is provided with a plurality of contact springs 57. The contacting plates 59 are electrically connected to the respective legs 21. In an embodiment, the contacting plates 59 are welded to the inner faces 37 of the legs 21. The two contacting plates 59 are located opposite one another across the flat contact receptacle 9. The contacting plates 59 and contacting sections 55 are spaced apart from the blocking element 15 counter to the insertion direction 17. A free space 61, which extends between the contacting sections 55 and the blocking element 15, may receive a touch protector (not shown), which can be arranged around an electrically conductive part of the flat contact 63.

Figure 4:
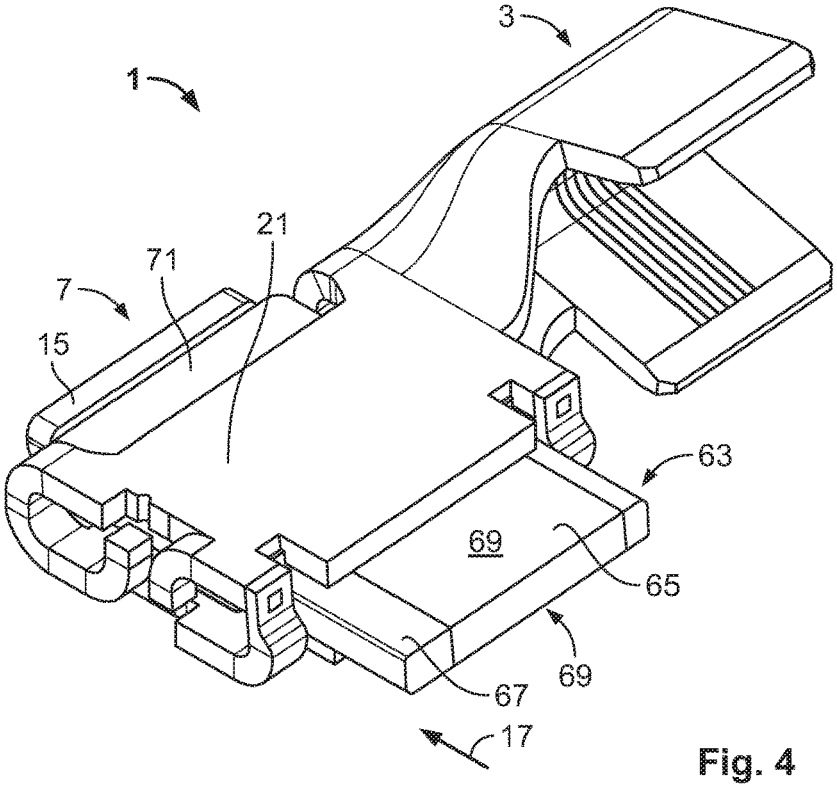
FIG. 4 is a perspective view of the flat contact socket of FIG. 1 with a flat contact.

The flat contact socket 1 is shown in FIG. 4 with the flat contact 63 disposed in the flat contact receptacle 9. The flat contact 63 has an electrically conductive portion 65 surrounded by a touch protector 67. Contacting surfaces 69 of the electrically conductive portion 65 are exposed. In the inserted state, the flat contact 63 abuts against the blocking element 15 with a front end 71 of the touch protector 67. The front end 71 of the touch protector 67 is arranged in the free space 61. The contacting surfaces 69 abut the two contacting sections 55 of the flat contact socket 1 such that an electrical connection is established.

Figure 5:
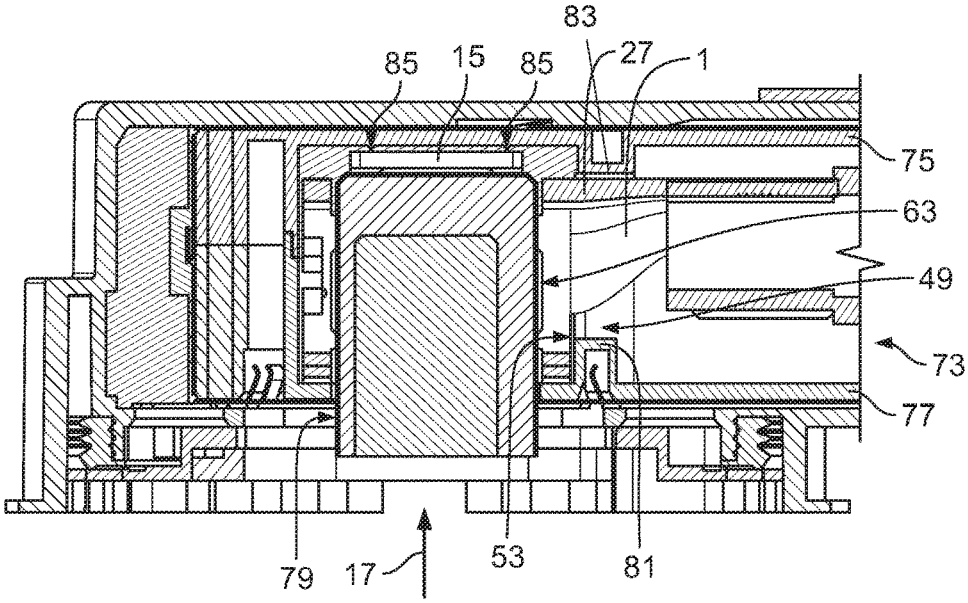
FIG. 5 is a sectional view of the flat contact socket of FIG. 1 in a housing.

The flat contact socket 1 is shown in FIG. 5 disposed in a two-part housing 73 with a flat contact 63 disposed in the flat contact receptacle 9. The housing 73 includes an upper part 75 and a lower part 77. The two parts 75 and 77 can be connected, for example, by suitable catching elements (not shown) or other forms of connection known to those with ordinary skill in the art. The housing 73 includes an opening 79 through which the flat contact 63 can enter into the interior of the housing 73 and thus into the flat contact receptacle 9 of the flat contact socket 1. The housing 73 has at least one further opening (not shown) through which an electrical conductor can be connected to the connection section 3 of the flat contact socket 1.

The housing 73 has on the lower part 77 a positive engagement element 81 which protrudes into an interior of the housing 73, as shown in the assembled state of FIG. 5. The positive engagement element 81 is arranged in the positive engagement recess 49 of the flat contact socket 1 and is located against the stop surface 53. The flat contact socket 1 is thereby positively secured against being pulled out of the housing 73 in the direction of the connection section 3. The engagement between the positive engagement element 81 and the positive engagement recess 49 also serves to avoid faults when assembling the housing parts 75 and 77 or when inserting the flat contact socket 1 into the housing 73. If, for example, the flat contact socket 1 was inserted into the lower part 77 such that the base 27 was located against the positive engagement element 81, the upper part 75 could no longer be moved towards the lower part 77 and the two parts 75, 77 could not be connected.

The upper part 75 has a pressing element 83, as shown in FIG. 5, which is arranged opposite the positive engagement element 81 counter to the insertion direction 17. In the assembled state, the pressing element 83 presses on the base 27 of the flat contact socket 1 such that it is held securely in the insertion direction 17. Moreover, the upper part 75 of the housing has one or more protrusions 85 which press against the blocking element 15 of the flat contact socket 1 in the assembled state, ensuring a secure fitting of the flat contact socket 1 in the housing 73 in the region of the blocking element 15 and reducing vibrations or oscillations of the blocking element 15. In another embodiment, the blocking element 15 can have a depression or groove into which the protrusion 85 can enter such that an additional positive engagement can also be obtained therein, transverse to the insertion direction 17.

Figure 6:
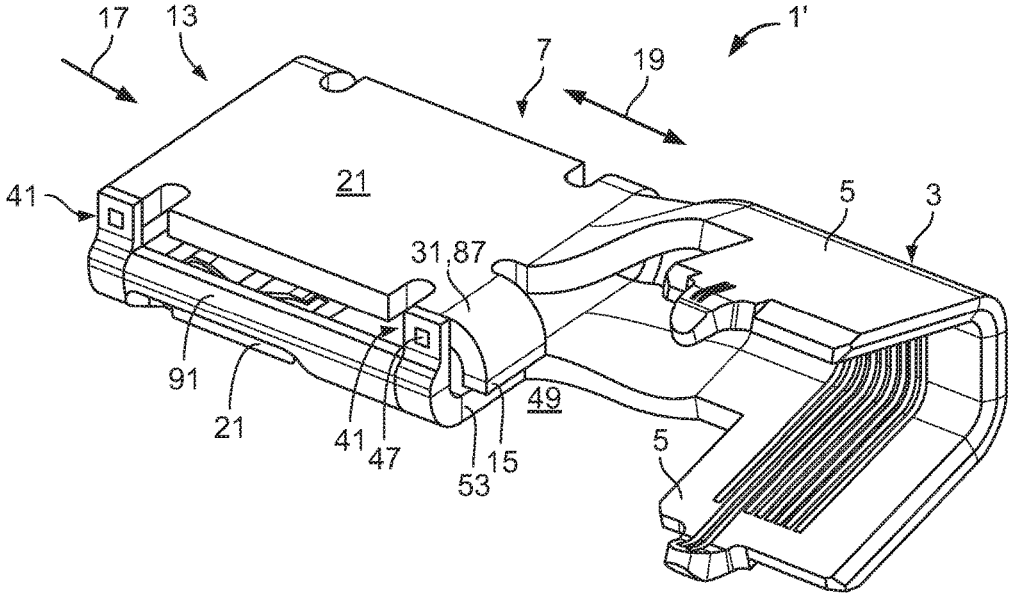
FIG. 6 is a perspective view of a flat contact socket according to another embodiment of the invention.
Figure 7:
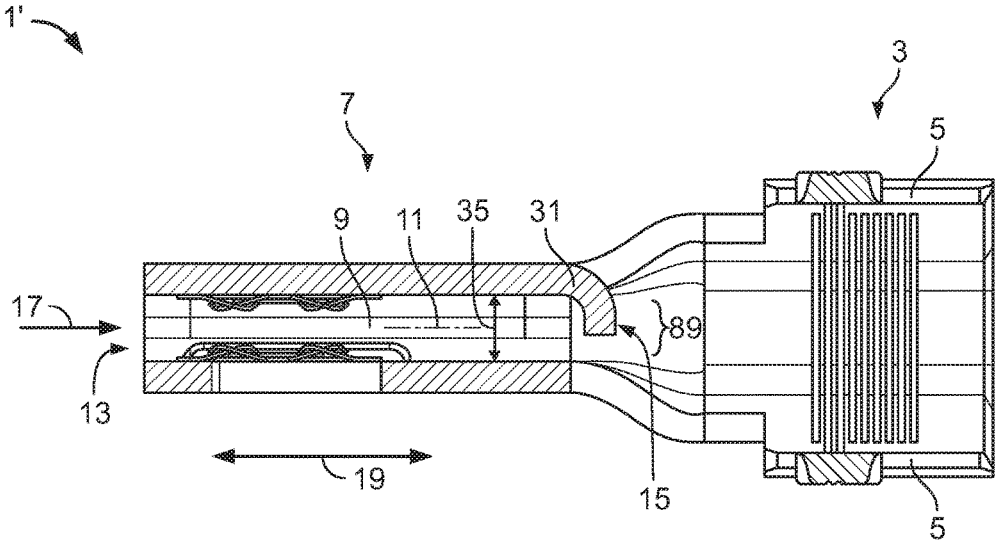
FIG. 7 is a top sectional view of the flat contact socket of FIG. 6.

A flat contact socket 1' according to another embodiment of the invention is shown in FIGS. 6 and 7. Like reference numbers indicate like elements and only the differences with respect to the embodiment of the flat contact socket 1 shown in FIGS. 1-5 will be described in detail herein.

The flat contact socket 1' can be used for a 180° connection; the socket body 7 and the connection section 3 are arranged relative to each other such that an electrical conductor runs substantially parallel to the insertion direction 17, at least in the connection section 3. The insertion direction 17 consequently extends parallel to the longitudinal direction 19. The insertion opening 13 is therefore arranged on the end of the socket body 7 located in the longitudinal direction 19 and not on the side thereof.

The blocking element 15, as shown in FIGS. 6 and 7, extends from one of the legs 21 in the insertion direction 17 and therefore substantially in the direction of the connection section 3. The cantilever 31, which extends in the insertion direction 17, and the blocking element 15, which protrudes transverse to the insertion direction 17, thus merge into each other. The blocking element 15 and the cantilever 31 can be formed as a bent tongue 87, the end section 89 thereof being formed by the blocking element 15. As with the previously described embodiment, the blocking element 15 extends transverse to the flat contact plane 11 over half the height 35 of the flat contact receptacle 9.

As with the first embodiment of the flat contact socket 1, here too the two legs 21 of the flat contact socket 1' are connected to each other by latching elements 41. However, in the flat contact socket 1', in the region between the two latching elements 41, a blocking web 91 extends which prevents an unintentional insertion of the flat contact 63 transverse to the insertion direction 17, i.e. between the two latching elements 41.

The cantilever 31 of the flat contact socket 1', as shown in FIGS. 6 and 7, extends from the latching element 41 which is located nearer to the connection section 3. The cantilever 31 extends from the part of the leg 21 which is provided with the positive engagement protrusion 47 of this latching element 41. The cantilever 31 and the positive engagement protrusion 47 extend substantially perpendicular to each other.

The arrangement of the blocking element 15 in the flat contact socket 1' does not preclude the presence of a positive engagement recess 49 with a stop surface 53 which runs transverse to the longitudinal direction 19. In the flat contact socket 1', the positive engagement recess 49 does not extend through the flat contact socket 1 continuously transverse to the flat contact receptacle 11, instead, the stop surface 53 is arranged on the leg 21 which is opposite the blocking element 15. The positive engagement recess 49 extends between this stop surface 53 and the two crimping wings 5 of the connection section 3.

What is claimed is:

1. A flat contact socket, comprising:

a connection section; and a socket body connected to the connection section and having:

a flat contact receptacle extending along a flat contact plane, the flat contact receptacle receiving a flat contact in an insertion direction at an insertion opening of the flat contact receptacle, and a plurality of legs connected by a web, the legs disposed opposite one another in a direction transverse to the flat contact plane, the legs delimiting the flat contact receptacle in the direction transverse to the flat contact plane, and the web disposed opposite the insertion opening in the insertion direction, and a blocking element positioned opposite the insertion opening in the insertion direction and delimiting the flat contact receptacle in the insertion direction, the blocking element extending transverse to the insertion direction from a cantilever extending in the insertion direction.

2. The flat contact socket of claim 1, wherein the connection section and socket body are monolithically formed by stamping and bending.

3. The flat contact socket of claim 1, wherein the socket body has a brace connecting the blocking element to the cantilever.

4. The flat contact socket of claim 1, wherein the blocking element extends up to at least half a height of the flat contact receptacle in a direction transverse to the flat contact plane.

5. The flat contact socket of claim 1, wherein at least one of the legs has a contacting section on an inner face of the leg electrically connecting with the flat contact.

6. The flat contact socket of claim 5, wherein the contact section has a contact spring projecting into the flat contact receptacle and resiliently deflectable toward the at least one leg.

7. The flat contact socket of claim 1, wherein the socket body has a base disposed opposite the insertion opening in the insertion direction and connected to the connection section, the base extending transverse to the insertion direction.

8. The flat contact socket of claim 7, wherein the flat contact socket is monolithically formed by stamping and bending.

9. The flat contact socket of claim 8, wherein the base is a main bending edge about which the stamped flat contact socket is bent.

10. The flat contact socket of claim 9, wherein the blocking element is at least partially formed from a material of the main bending edge and the blocking element is spaced apart from the main bending edge in the insertion direction.

11. The flat contact socket of claim 1, wherein the connection section has a plurality of crimping wings.

12. The flat contact socket of claim 1, further comprising a positive engagement recess extending substantially parallel to the insertion direction into the connection section.

13. The flat contact socket of claim 12, wherein the positive engagement recess engages with a housing.

14. The flat contact socket of claim 13, wherein the positive engagement recess forms a stop surface on the socket body extending parallel to the insertion direction.

15. The flat contact socket of claim 14, wherein the stop surface engages the housing to secure the flat contact socket in the housing.

16. The flat contact socket of claim 1, wherein the socket body has a lateral blocking element extending from each leg and delimiting the flat contact receptacle in a direction transverse to the insertion direction.

* * * * *